US006850724B2

(12) United States Patent
Pang et al.

(10) Patent No.: US 6,850,724 B2
(45) Date of Patent: Feb. 1, 2005

(54) LIQUID DEVELOPING UNIT USING HIGH DENSITY INK

(75) Inventors: Jeong-hun Pang, Gyeonggi-do (KR); Young-ha No, Gyeonggi-do (KR); Kwang-ho No, Gyeonggi-do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/368,378

(22) Filed: Feb. 20, 2003

(65) Prior Publication Data

US 2003/0164985 A1 Sep. 4, 2003

(30) Foreign Application Priority Data

Feb. 21, 2002 (KR) ..... 2002-9285

(51) Int. Cl.[7] ..... G03G 15/10
(52) U.S. Cl. ..... 399/248; 399/237; 399/239
(58) Field of Search ..... 399/233, 237, 399/239, 240, 248, 249

(56) References Cited

U.S. PATENT DOCUMENTS 4,024,838 A * 5/1977 Horie ..... 399/239
4,493,550 A * 1/1985 Takekida ..... 399/240
4,982,692 A * 1/1991 Uematsu ..... 399/239
5,089,853 A * 2/1992 Uematsu ..... 399/239
5,561,264 A * 10/1996 Iino et al. ..... 399/240
5,610,694 A * 3/1997 Lior et al. ..... 399/240
5,918,093 A * 6/1999 Kim ..... 399/237
6,052,550 A * 4/2000 Thornton et al. ..... 399/237
6,166,752 A * 12/2000 Izumi ..... 399/240 X
6,167,225 A * 12/2000 Sasaki et al. ..... 399/237
6,453,141 B2 * 9/2002 Kitoba et al. ..... 399/237

FOREIGN PATENT DOCUMENTS

JP 2-306275 12/1990

* cited by examiner

*Primary Examiner*—Sandra L. Brase
(74) *Attorney, Agent, or Firm*—Staas & Halsey LLP

(57) ABSTRACT

A developing unit using a high concentration ink includes a developing solution supply unit supplying the developing solution containing the high concentration ink, a developing roller, whose lower half is soaked in the developing solution of the developing solution supply unit, absorbing the developing solution by a surface tension, and a photosensitive drum contacting the developing roller, receiving the developing solution absorbed on a surface of the developing roller and developing a latent electrostatic image formed on a surface of the photosensitive drum. Accordingly, as much as about 100% of a binary ink development (BID) is achieved, thereby providing a high quality image.

22 Claims, 3 Drawing Sheets

LIQUID DEVELOPING UNIT USING HIGH DENSITY INK

CROSS-REFERENCE TO RELATED APPLICATIONS

This application claims the benefit of Korean Patent Application No. 2002-9285, filed Feb. 21, 2002 in the Korean Industrial Property Office, the disclosure of which is incorporated herein by reference.

BACKGROUND OF THE INVENTION

1. Field of the Invention

The present invention relates to a liquid developing unit employed in an image forming apparatus, and more particularly, to a liquid developing unit which is capable of achieving a high binary ink development (BID) with a simple structure.

2. Description of the Related Art

A conventional image forming apparatus includes a charger increasing a potential of a surface of a photosensitive belt, an exposing unit forming a latent electrostatic image by radiating a beam onto the charged photosensitive belt, a developing unit developing an image by supplying a developing solution to the latent electrostatic image, a dryer drying a carrier from the developing solution to form the image, a transferring unit transferring the dried image onto paper, and a fixing unit fixing the transferred image on the paper by applying heat or pressure to the transferred image of the paper.

Here, a conventional developing unit 10 is shown in FIG. 1. Referring to FIG. 1, the conventional developing unit 10 includes a developing solution supply unit 12 supplying a developing solution 30, a developing roller 13, whose lower half is soaked (immersed) in the developing solution 30, supplying the developing solution 30 to a photosensitive drum 11, the photosensitive drum 11 contacting the developing roller 13 and developing a latent electrostatic image with the developing solution 30 to form an image, a depositing roller 15 contacting the developing roller 13 to deposit the developing solution 30 on the developing roller 13, and a cleaning roller 17 rotating while contacting the developing roller 13 to clean the developing solution 30 remaining on the developing roller 13 after the development of the latent electrostatic image.

A developing process in the conventional developing unit 10 includes depositing the developing solution 30 on the developing roller 13 using the depositing roller 15, metering and squeezing an ink layer 20 deposited on the developing roller 13 using a metering blade 19, developing the latent electrostatic image with the developing solution 30 transferred from the developing roller 13 onto the photosensitive drum 11 by a first potential difference in a developing gap formed between the developing roller 13 and the photosensitive drum 11, pressing toner (developing solution 30) and fixing the developed image on the paper, and cleaning the developing roller 13 by removing the developing solution 30 remaining on the developing roller 13 using the cleaning roller 17 after the development of the latent electrostatic image.

First, a principle of a depositing operation is simply shown in a circle A. An electric field E is formed between a surface 29 of the depositing roller 15 and the developing roller 13 having a resistance layer 23 and a conductive layer 21 by a difference between a first voltage supplied to the depositing roller 15 and a second voltage supplied to the developing roller 13, and ink particles (ink) of the developing solution 30 having charge "q" are transferred to and deposited on the developing roller 13 from the depositing roller 15 by a Coulomb force (F=qE).

A metering operation after the depositing operation is shown in a circle B. The metering of the ink layer 20 forms a uniform thickness (mass per area (M/A)) of the ink layer 20, which is deposited on the developing roller 13 by a second potential difference between the depositing roller 15 and the developing roller 13. The metering of the ink layer 20 also squeezes a carrier of the developing solution 30 and applies physical pressure to the ink layer 20 using the metering blade 19 to form a high concentration (% solid) layer as shown in the circle B.

As shown in a circle C, a developing operation after the metering operation is performed in a developing gap between the photosensitive drum 11 and the developing roller 13. The ink particles (ink) of the developing solution 30 are charged by the first potential difference between a surface 25 of the photosensitive drum 11 and the developing roller 13 having the conductive layer 21 and the resistance layer 23 stacked on the conductive layer 21. The ink particles move to the surface 25 of the photosensitive drum 11 from the resistance layer 23 of the developing roller 13.

Last, as shown in a circle D, the developing solution 30 remaining on the developing roller 13 after the development of the latent electrostatic image is cleaned by the cleaning roller 17 having a sponge shape, thereby completing the above developing process.

In the conventional developing unit 10, the developing solution 30 having ink having a high concentration and a carrier is transferred through the developing gap in the developing operation, and thus a surplus carrier is captured (recollected) from the ink layer 20 of the developing roller 20 into the developing solution supply unit 12 in the metering operation, and the concentration of the ink of the developing solution 30 contained in the developing solution supply unit 12 continuously decreases. Therefore, an amount and concentration of the toner (ink) containing in the ink layer 20 formed on the developing roller 13 after the metering operation cannot be irrelevant to the concentration of the developing solution 30 contained in the developing solution supply unit 12 even though the metering operation is performed accurately. For this reason, the concentration of the ink of the developing solution 30 varies, and 100% of a binary ink development (BID, a developing efficiency of the developing unit) cannot be achieved.

Also, in a case that the 100% of the BID is not achieved during the development of the latent electrostatic image, the cleaning roller 17 being overloaded to remove residual toner (ink) from the developing roller 13 by an electric force should be installed in the developing solution supply unit 12. However, since the cleaning roller 17 contacts the developing roller 13 which requires an accurate driving speed and applies a rotation load to the developing roller 13, the image deteriorates.

SUMMARY OF THE INVENTION

To solve the above and other problems, it is an object of the present invention to provide a developing unit having a simple structure using ink having a high concentration to achieve as much as about 100% of a binary ink development (BID, a developing efficiency of the developing unit).

Additional objects and advantageous of the invention will be set forth in part in the description which follows and, in part, will be obvious from the description, or may be learned by practice of the invention.

Accordingly, to achieve the above and other objects, there is provided a developing unit. The developing unit includes a developing solution supply unit supplying a developing solution containing high concentration ink, a developing roller, whose lower half is soaked (immersed) in the developing solution of the developing solution supply unit, absorbing the developing solution by a surface tension, and a photosensitive drum contacting the developing roller to receive the developing solution from a surface of the developing roller and developing a latent electrostatic image formed on a surface of the photosensitive drum with the received developing solution.

It is possible that the developing unit further includes a metering unit contacting the developing roller and metering the developing solution of the developing roller after the deposition of the developing solution on the developing roller.

Here, the developing unit may further include a cleaning roller contacting the developing roller and removing the developing solution remaining on the developing roller after the development of the latent electrostatic image.

According to an aspect of the present invention, the developing roller has a volume resistance of about $10^4$–$10^9\Omega$ and a hardness of about Shore A 10–70 degrees. The surface tension is generated when the developing roller has the above volume resistance and hardness and when the developing solution has a high concentration of solid ink particles.

According to another aspect of the present invention, the developing solution is deposited on the surface of the developing roller by the surface tension formed between the developing roller and the ink without using a depositing roller, a metering blade, and a cleaning roller all used in a conventional developing unit. The developing solution has high concentration ink, so that the ink concentration (% solid) of the developing solution contained in the developing solution supply unit of the developing unit is the same as the ink concentration (% solid) deposited on the developing roller, thereby achieving as much as about 100% of a binary ink development (BID, a developing efficiency of the developing unit transferring the developing solution from the developing solution supply unit to the photosensitive drum through the developing roller).

BRIEF DESCRIPTION OF THE DRAWINGS

These and other objects and advantageous of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
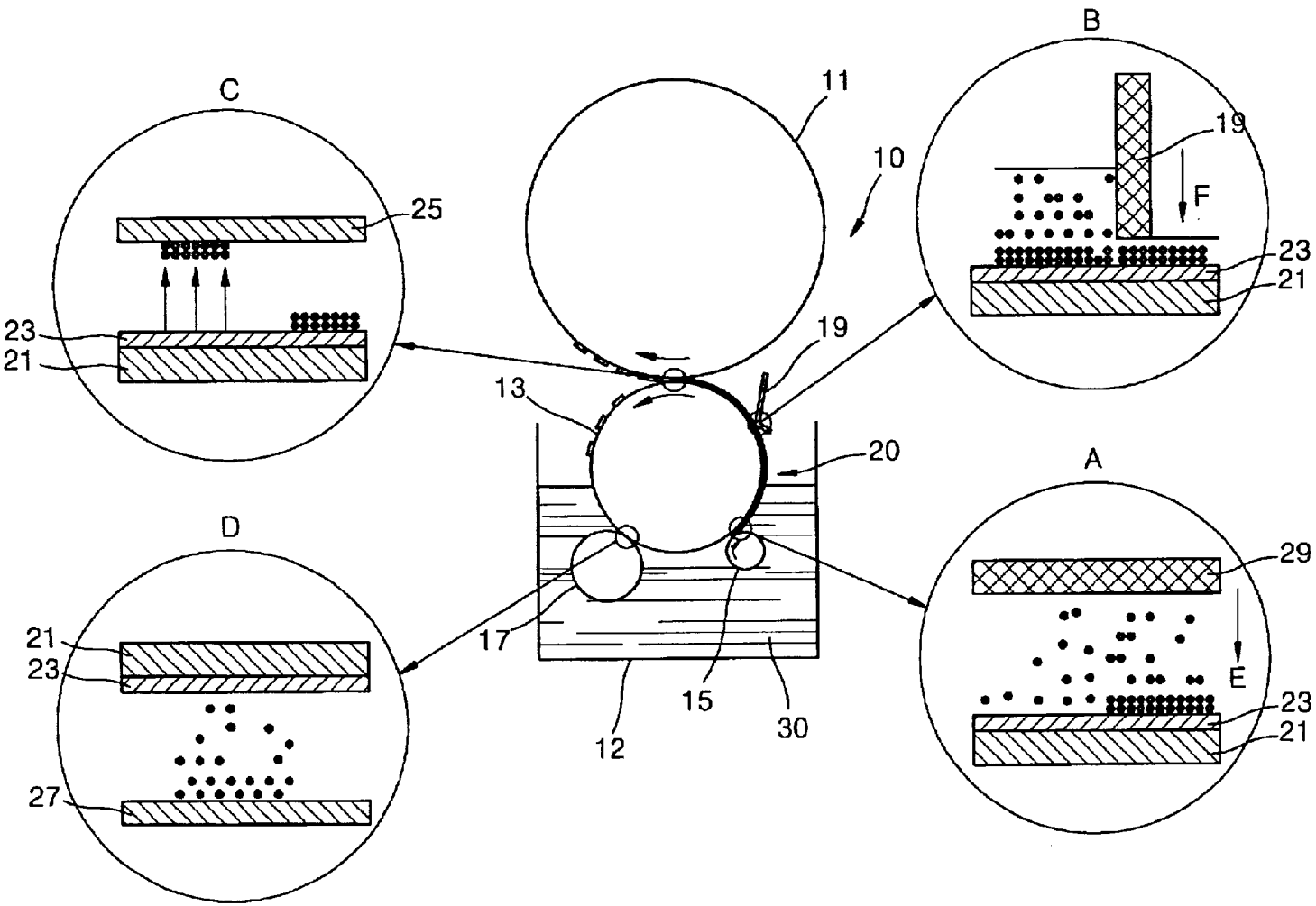
FIG. 1 (PRIOR ART)
FIG. 1 illustrates a conventional liquid developing unit and an operational principle of each element of the developing unit.

Reference will now be made in detail to the present preferred embodiments of the present invention, examples of which are illustrated in the accompanying drawings, wherein like reference numerals refer to the like elements throughout. The embodiments are described in order to explain the present invention by referring to the figures.

Hereinafter, a developing unit according to the present invention will be described in detail with reference to the attached drawings.

Figure 2:
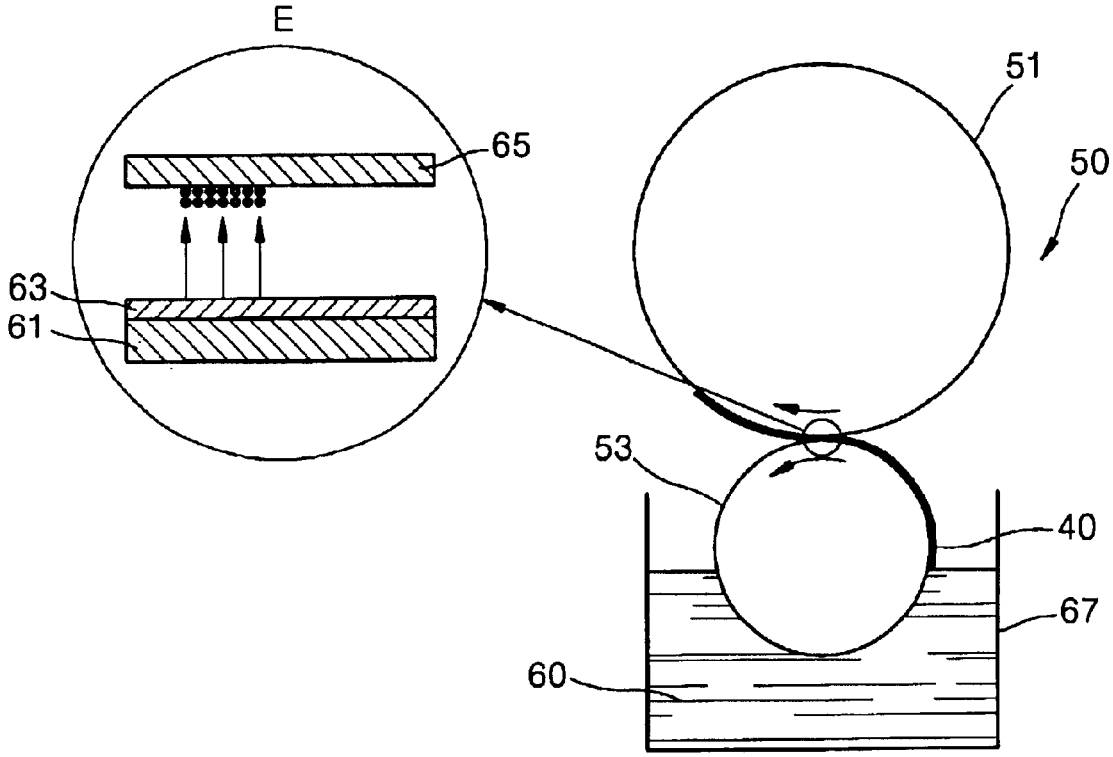
FIG. 2 illustrates a liquid developing unit according to an embodiment of the present invention.

FIG. 2 illustrates a liquid developing unit 50 according to an embodiment of the present invention. Referring to FIG. 2, the liquid developing unit 50 includes a developing solution supply unit 67 containing a developing solution 60 of high concentration ink, a developing roller 53, whose lower half is soaked (immersed) in the developing solution 60 of the developing solution supply unit 67, absorbing the developing solution 60 by a surface tension of a surface of the developing roller 53, and a photosensitive drum 51 contacting the developing roller 53, receiving an ink film 40 of the developing solution 60 absorbed on the surface of the developing roller 53 and developing a latent electrostatic image formed on a surface of the photosensitive drum 51.

In the developing unit 50 according to this embodiment of the present invention, the high concentration developing solution 60 having a 3–15% concentration is absorbed on the developing roller 53 to form the ink film 40 by the surface tension due to a viscosity of the developing solution 60, and thus an additional depositing roller, such as a depositing roller 15 of FIG. 1, is not required. If the concentration of the developing solution is greater than about 3% concentration (at least 3% solid ink particles), the ink film 40 can be deposited on the developing roller 53 without using the additional depositing roller and may have the same concentration as the developing solution 60 contained in the developing solution supply unit 67 because the developing solution 60 having the high concentration of more than 3% solid ink particles has the viscosity sufficient to be deposited on the developing roller 53 by the surface tension.

As shown in a circle E of FIG. 1, ink particles of the ink film 40 of the developing solution 60 move to the photosensitive drum 51 from the developing roller 53. As described above, the ink particles of the developing solution 60 absorbed on the developing roller 53 move to the photosensitive drum 51 from the developing roller 53 by an electric force due to a potential difference between the photosensitive drum 51 and the developing roller 53, that is, a bias vector.

The developing roller 53 includes a resistance layer 61 and a conductive layer 63 and is formed of polyurethane or nitryl butadiene rubber (NBR) having a volume resistance of about $10^4$–$10^9\Omega$, and a hardness of about Shore A 10–70 degrees, preferably, 25–65 degrees. The surface tension is generated when the developing roller has the above volume resistance and hardness and when the developing solution has a high concentration of solid ink particles.

The developing unit 50 can be manufactured with simple elements by removing a depositing roller, a metering blade, and a cleaning roller that are included in a conventional developing unit and by transferring the developing solution only by the surface tension. By using the developing solution 60 having the high concentration, the developing unit 50 may achieve as much as about 100% of a binary ink development (BID, a developing efficiency of the developing unit 50 transferring the developing solution 60 from the developing solution supply unit 67 to the photosensitive drum 51 through the developing roller 53), thereby providing a high quality image. However, the metering blade or the cleaning roller may be further included depending on conditions of the developing solution 60.

Figure 3:
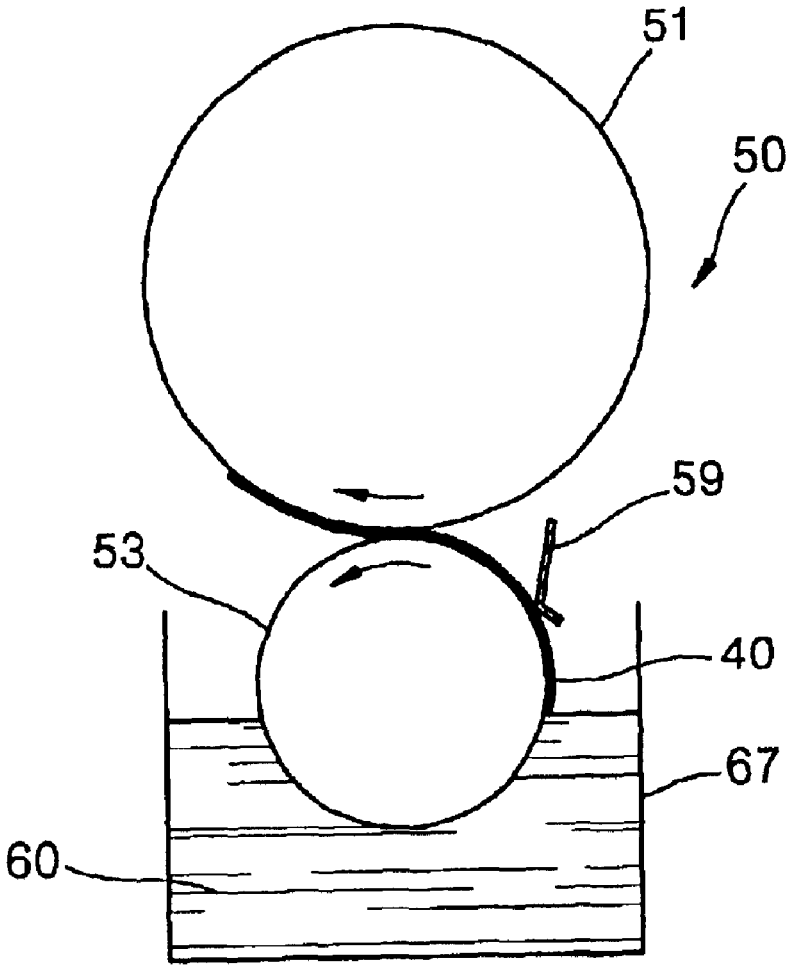
FIG. 3 illustrates a liquid developing unit according to another embodiment of the present invention.

FIG. 3 illustrates a liquid developing unit 50 according to another embodiment of the present invention. Referring to FIG. 3, the developing unit 50 further includes a metering unit 59 in the developing unit 50 of FIG. 2 to contact the developing roller 53 or to form a predetermined gap with the developing roller 53.

A concentration of an image varies according to a printed image, and thus a difference in concentrations of the developing solution 60 may occur when the ink particles and the carrier are transferred onto the photosensitive drum 51. For example, in a case that the image having a high image concentration is printed, the ink particles are more consumed than the carrier, and more carrier remains in the developing solution supply unit 67, and thus the concentration of the developing solution 60 decreases. To the contrary, in another case that the image having a low image concentration is printed, the consumption of the ink particles is less than that of the carrier, and thus the concentration of the developing solution 60 increases.

In consequence, a variation in the image concentration causes both a variation in the developing solution 60 contained in the developing solution supply unit 67 and a variation in an ink film 40 absorbed on the developing roller 53. Thus, the developing unit 50 according to another embodiment of the present invention further includes the metering unit 59 to maintain the concentration of the ink film 40.

In a case that various color images are printed, it is possible that the developing unit 50 according to an aspect of the present invention further includes the metering unit 59. However, the image concentration is nearly maintained uniform (constant) in a printer in which only image concentration having a single color is used. When the concentration of the developing solution 60 is maintained invariable, the metering unit 59 is not required, and thus printer having the developing unit according to the first embodiment of the present invention is more preferable. A cleaning roller may be further included in the developing unit, so that the residual developing solution 60 remaining on the developing roller 53 is cleaned, thereby improving a developing performance of the developing roller 53.

The developing unit 50 according to these embodiments of the present invention can maintain as much as about 100% of the BID only by using the surface tension between the developing solution 60 and the developing roller 53, thereby providing the high quality image.

This invention has been particularly shown and described with reference to preferred embodiments thereof, but this does not limit the scope of the invention but should be interpreted as an example of the preferred embodiments. In particular, it will be understood by those skilled in the art that a developing roller, whose surface is processed or formed of a suitable material to increase the surface tension, may be used in the developing unit.

As described above, the developing unit according to the present invention can absorb a developing solution on a surface of a developing roller only by the surface tension between the developing solution having a high concentration and the developing roller to achieve as much as about 100% of the binary ink development (BID), thereby providing the high quality image.

Although a few preferred embodiments of the present invention have been shown and described, it would be appreciated by those skilled in the art that changes may be made in this embodiment without departing from the principles and sprit of the invention, the scope of which is defined in the claims and their equivalents.

What is claimed is:

1. A developing unit comprising:

a developing solution supply unit containing a developing solution of a concentration of ink particles of at least 3%;

a developing roller having a portion immersed in the developing solution of the developing solution supply unit, absorbing the developing solution by a surface tension due to the concentration of the ink particles between the developing solution and the portion of the developing roller immersed in the developing solution of the developing solution supply unit; and a photosensitive drum contacting the developing roller, receiving the developing solution deposited on the surface of the developing roller, and developing a latent electrostatic image formed on a surface of the photosensitive drum with the received developing solution.

2. The developing unit of claim 1, further comprising:

a metering unit contacting the developing roller and metering the developing solution of the developing roller after a deposition of the developing solution on the developing roller by the surface tension.

3. The developing unit of claim 1, further comprising:

a cleaning roller contacting the developing roller to remove the developing solution remaining on the developing roller after a development of the latent electrostatic image.

4. The developing unit of claim 1, wherein the developing roller has a volume resistance of about $10^4$–$10^9\Omega$.

5. The developing unit of claim 1, wherein the developing roller has a hardness of about Shore A 10–70 degrees.

6. A developing unit comprising:

a developing solution supply unit containing a developing solution having a concentration of ink particles of at least 3%;

a developing roller having a surface tension due to the concentration of the ink particles formed between the developing solution and the developing roller and absorbing the developing solution by the surface tension to form an ink film having the same concentration as the developing solution on a surface of the developing roller; and a photosensitive drum having a latent electrostatic image, contacting the developing roller to receive the ink film from the developing roller, and developing the latent electrostatic image with the received ink film of the developing solution.

7. The developing unit of claim 6, wherein the developing roller does not use a depositing roller immersed in the developing solution to deposit the developing solution on the surface of the developing roller.

8. The developing unit of claim 6, wherein the developing roller comprises a conductive layer and a resistance layer formed on the conductive layer, and the resistance layer comprises nitryl butadiene rubber (NBR).

9. The developing unit of claim 8, wherein the resistance layer has a volume resistance between $10^4$ and $10^9\Omega$ inclusive and a hardness of Shore A between 10 and 70 inclusive.

10. The developing unit of claim 9, wherein the hardness of Shore A of the developing roller is between 25 and 65 inclusive.

11. The developing unit of claim 6, wherein the developing solution comprises a carrier and ink particles, and a concentration of the ink particles both in the developing solution and in the ink film is equal to or more than 3%.

12. The developing unit of claim 11, wherein the ink particles are in a solid state, and the concentration of the ink particles in the developing solution and the ink film is between 3% and 15% inclusive.

13. The developing unit of claim 6, wherein the developing roller absorbs the developing solution using the surface tension to achieve a developing efficiency of about 100% when the developing solution is transferred from the developing solution supply unit to the photosensitive drum through the developing roller.

14. The developing unit of claim 6, wherein the developing solution has a predetermined viscosity so as to be deposited on the surface of the developing roller by the surface tension.

15. The developing unit of claim 6, wherein the concentration of the developing solution contained in the developing solution supply unit is maintained constant when the developing solution is transferred to the developing roller to form the ink film by the surface tension.

16. The developing unit of claim 6, wherein the developing roller comprises a first portion and a second portion, and the first portion of the developing roller is immersed in the developing solution contained in the developing solution supply unit to deposit the ink film on the surface of the developing roller using the surface tension while the second portion of the developing roller contacts the photosensitive drum through the ink film to transfer the ink film from the surface of the developing roller to the photosensitive drum.

17. The developing unit of claim 6, wherein the developing roller transfers the ink film to the photosensitive drum by using an electric force generated by a voltage potential between the developing roller and the photosensitive drum.

18. A developing unit comprising:

a developing solution supply unit containing a developing solution having a concentration of ink particles of at least 3%;

a photosensitive drum having a latent electrostatic image; and a developing roller disposed between the developing solution supply unit and the photosensitive drum, having a surface tension formed with the developing solution due to the concentration of ink particles, having an electric force generated from a voltage difference between the developing roller and the photosensitive drum, absorbing the developing solution using the surface tension to form an ink film on a surface of the developing roller, and transferring the ink film to the photosensitive drum using the electric force.

19. The developing unit of claim 18, wherein the developing roller comprises a first portion being immersed in the developing solution of the developing solution supply unit and a second portion not being immersed in the developing solution of the developing solution supply unit but contacting the photosensitive drum trough the ink film.

20. The developing unit of claim 19, wherein the ink film is formed on the first portion of the developing roller by the surface tension, and the ink film of the developing roller is transferred to the photosensitive drum by the electric force.

21. The developing unit of claim 18, wherein the developing solution has a concentration of 3% solid ink particles, and the developing roller has volume resistance between $10^4$ and $10^9\Omega$ inclusive and a hardness of Shore A between 10 and 70 inclusive to form the ink film on the surface of the developing roller using the surface tension.

22. A developing unit comprising:

a developing solution supply unit to contain a developing solution having a concentration of ink particles of at least 3%;

a developing roller having a portion thereof to be immersed in title developing solution, to absorb the developing solution via a surface tension between the developing solution and the portion of the developing roller immersed in the developing solution; and a photosensitive drum to contact the developing roller, to receive the developing solution deposited on the surface of the developing roller, and to develop a latent electrostatic image formed on a surface of the photosensitive drum with the received developing solution.

* * * * *

UNITED STATES PATENT AND TRADEMARK OFFICE

CERTIFICATE OF CORRECTION

PATENT NO. : 6,850,724 B2
DATED : February 1, 2005
INVENTOR(S) : Jeong-hun Pang et al.

It is certified that error appears in the above-identified patent and that said Letters Patent is hereby corrected as shown below:

Column 8,
Line 13, change "trough" to -- through --;
Line 20, after "has" insert -- a --;
Line 29, change "title" to -- the --.

Signed and Sealed this

Second Day of August, 2005

JON W. DUDAS
*Director of the United States Patent and Trademark Office*